US006758729B2

(12) United States Patent
Fujishiro

(10) Patent No.: US 6,758,729 B2
(45) Date of Patent: Jul. 6, 2004

(54) CENTRIFUGAL BARREL FINISHING APPARATUS

(75) Inventor: Akihito Fujishiro, Aichi (JP)

(73) Assignee: Tipton Corp., Aichi (JP)

( * ) Notice: Subject to any disclaimer, the term of this patent is extended or adjusted under 35 U.S.C. 154(b) by 68 days.

(21) Appl. No.: 10/075,252

(22) Filed: Feb. 15, 2002

(65) Prior Publication Data

US 2002/0115393 A1 Aug. 22, 2002

(30) Foreign Application Priority Data

Feb. 20, 2001 (JP) ..... 2001-043626

(51) Int. Cl.[7] ..... B24B 31/02

(52) U.S. Cl. ..... 451/328; 451/60; 451/104; 451/329; 451/330; 51/163.2

(58) Field of Search ..... 451/32, 113, 104, 451/269, 271, 60, 326–330, 446; 51/163.2, 163.1

(56) References Cited

U.S. PATENT DOCUMENTS 4,257,198 A * 3/1981 Balz ..... 451/32
5,211,673 A * 5/1993 Ditscherlein ..... 451/327
5,355,638 A * 10/1994 Hoffman ..... 451/32
5,531,637 A * 7/1996 Kimura ..... 451/329
5,672,094 A * 9/1997 Nishimura et al. ..... 451/32
5,848,929 A * 12/1998 Hoffman ..... 451/32
5,989,109 A * 11/1999 Kobayashi et al. ..... 451/326

FOREIGN PATENT DOCUMENTS

GB 2226512 A * 7/1990 ..... B24B/31/02
JP 62-152668 7/1987
JP 8-19956 1/1996

* cited by examiner

*Primary Examiner*—Joseph J. Hail, III
*Assistant Examiner*—Anthony Ojini
(74) *Attorney, Agent, or Firm*—Wenderoth, Lind & Ponack, L.L.P.

(57) ABSTRACT

A centrifugal barrel finishing apparatus centrifugally polishing, grinding or otherwise finishing workpieces includes a revolving member mounted on a first rotatable shaft so as to be rotated with the first shaft, a barrel mounted to be rotated about a second shaft, the barrel having both axial ends, a stopper mounted on the second shaft so as to be abutted against one axial end side of the barrel, and a fluid pressure cylinder including a piston and mounted on the second shaft so that the piston pushes the other axial end side of the barrel so that the barrel is held between the stopper and the cylinder.

18 Claims, 8 Drawing Sheets

CENTRIFUGAL BARREL FINISHING APPARATUS

BACKGROUND OF THE INVENTION

1. Field of the Invention

This invention relates to a centrifugal barrel finishing apparatus including one or more barrels rotatably mounted on a turnable turret and rotated with turn of the turret so that workpieces contained in the barrels are centrifugally polished, ground or otherwise finished.

2. Description of the Related Art

Japanese Patent Application Publication No. 08019956A published on Jan. 23, 1996 discloses one of conventional centrifugal barrel finishing apparatuses of the above-described type. The disclosed apparatus comprises a pair of upper and lower disks turnable about a vertical axis. Two barrel holding plates are rotatably mounted on the disks respectively. Spring members are mounted so that each holding plate is urged toward the other holding plate side. The barrels are held between the holding plates by a spring force of the spring members so that the barrels mounted on the holding plates are rotated with turn of the holding plates.

Thus, the spring force of the spring members is used for holding the barrels in the conventional barrel finishing apparatuses. However, when each barrel is heavy and the spring force of each spring member is too small relative to a weight of each barrel, the barrels cannot be held reliably. Accordingly, each spring needs to have a large spring force enough to support the barrels. However, when spring members each having a large spring force are used, the spring members are overqualified when light-weight barrels are used.

SUMMARY OF THE INVENTION

Therefore, an object of the present invention is to provide a centrifugal barrel finishing apparatus in which a plurality of types of barrels having different weights can be held by an appropriate force.

The present invention provides a centrifugal barrel finishing apparatus comprising a revolving member mounted on a first rotatable shaft so as to be rotated with the first shaft, a barrel provided to be rotated about a second shaft, the barrel having both axial ends, a stopper provided on the second shaft so as to be abutted against one axial end side of the barrel, and a fluid pressure cylinder including a piston and mounted on the second shaft so that the piston pushes the other axial end side of the barrel so that the barrel is held between the stopper and the cylinder.

According to the above-described finishing apparatus, an appropriate holding force can be applied to the barrel since the pressure of the working fluid supplied into the fluid pressure cylinder is changed according to a weight of the barrel.

In a preferred form, the fluid pressure cylinder is disposed to be concentric with the second shaft. A rotation center of the second shaft corresponds with a center of gravity of an assembly of the second shaft and cylinder. Consequently, rotation of the second shaft can be rendered stable.

In another preferred form, the barrel includes a body having an open end and a lid closing the open end of the body, and either one of the piston and the stopper is abutted against the body of the barrel, whereas the other is abutted against the lid of the barrel. Furthermore, the stopper is formed into a shape of a frame surrounding the barrel and has an inner face guiding movement between a first position where the stopper is brought into a sliding contact with a mounting plate so that the barrel is held between the piston and the stopper and a second position where the barrel is released from a held state. In the foregoing construction, either one of the piston and the stopper is abutted against the body of the barrel, where as the other is abutted against the lid of the barrel. Since the piston is rotated together with the stopper, the barrel body and the lid are also rotated together. This construction can prevent slippage resulting from difference between the rotational speeds of the barrel body and the lid.

In further another preferred form, the second shaft has a hollow interior serving as a flow passage of a working fluid, the flow passage communicating with the cylinder. Consequently, the interior of the second shaft can be used more efficiently as compared with a case where the flow passage is provided outside the second shaft.

BRIEF DESCRIPTION OF THE DRAWINGS

Other objects, features and advantages of the present invention will become clear upon reviewing the following description of preferred embodiments, made with reference to the accompanying drawings, in which.

DETAILED DESCRIPTION OF EMBODIMENTS

Figure 1:
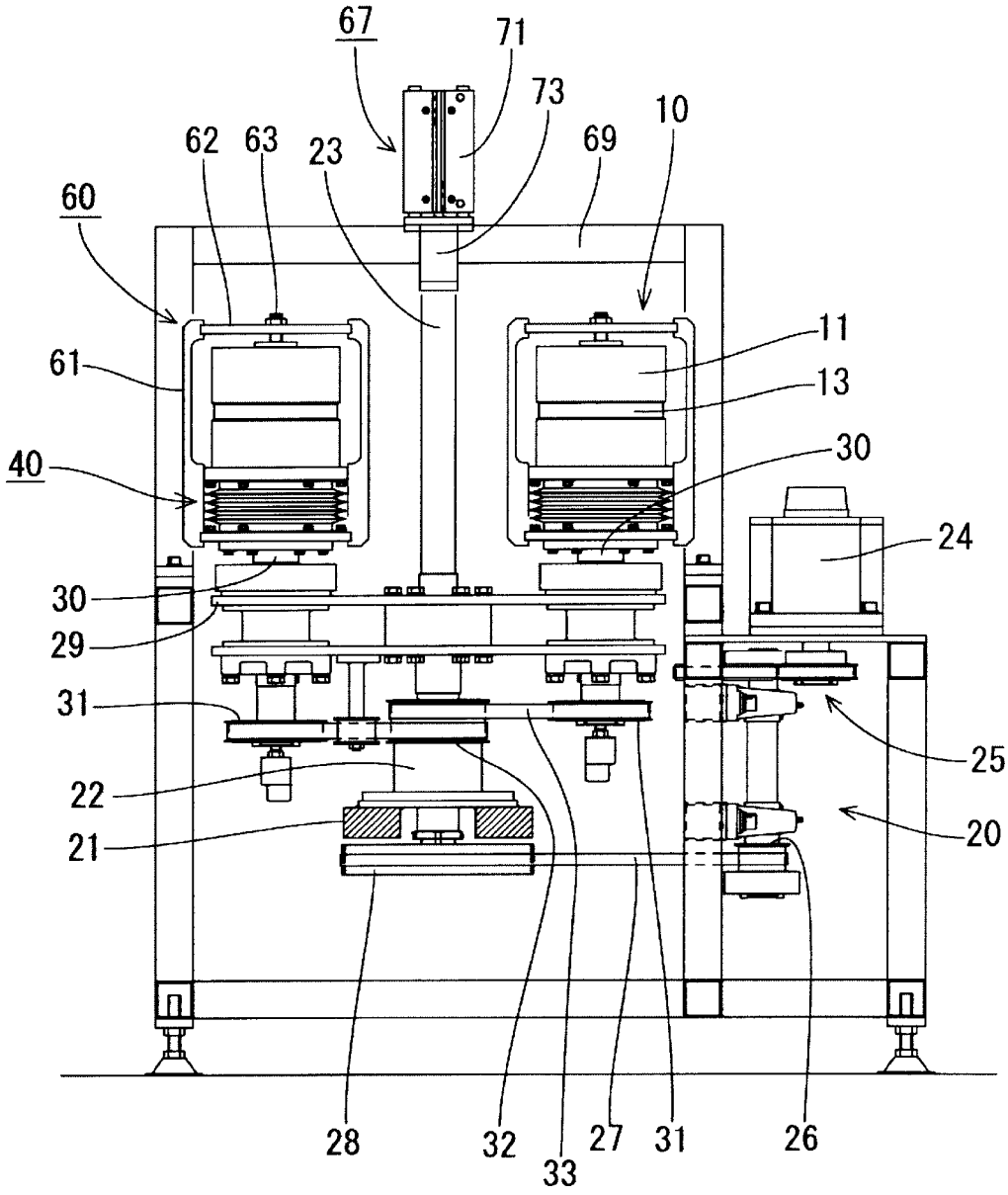
FIG. 1 is a front view of the centrifugal barrel finishing apparatus of one embodiment in accordance with the present invention.
Figure 2:
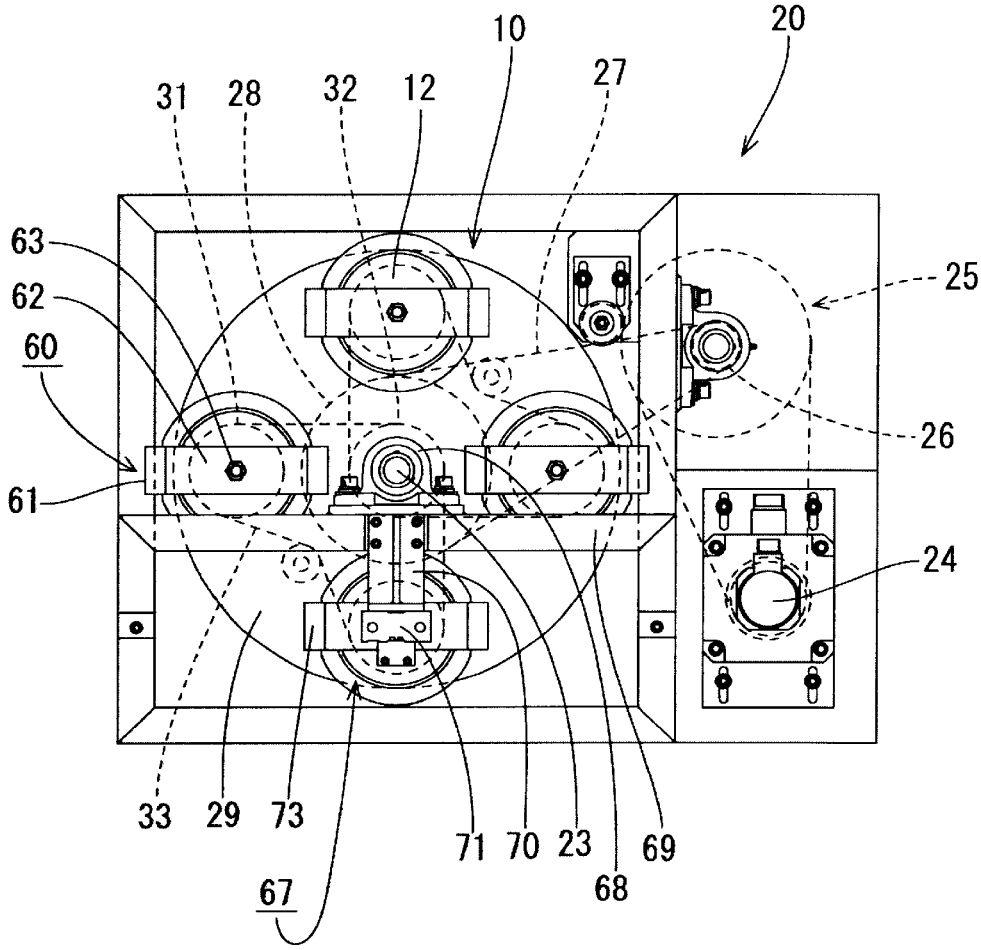
FIG. 2 is a plan view of the finishing apparatus.
Figure 3:
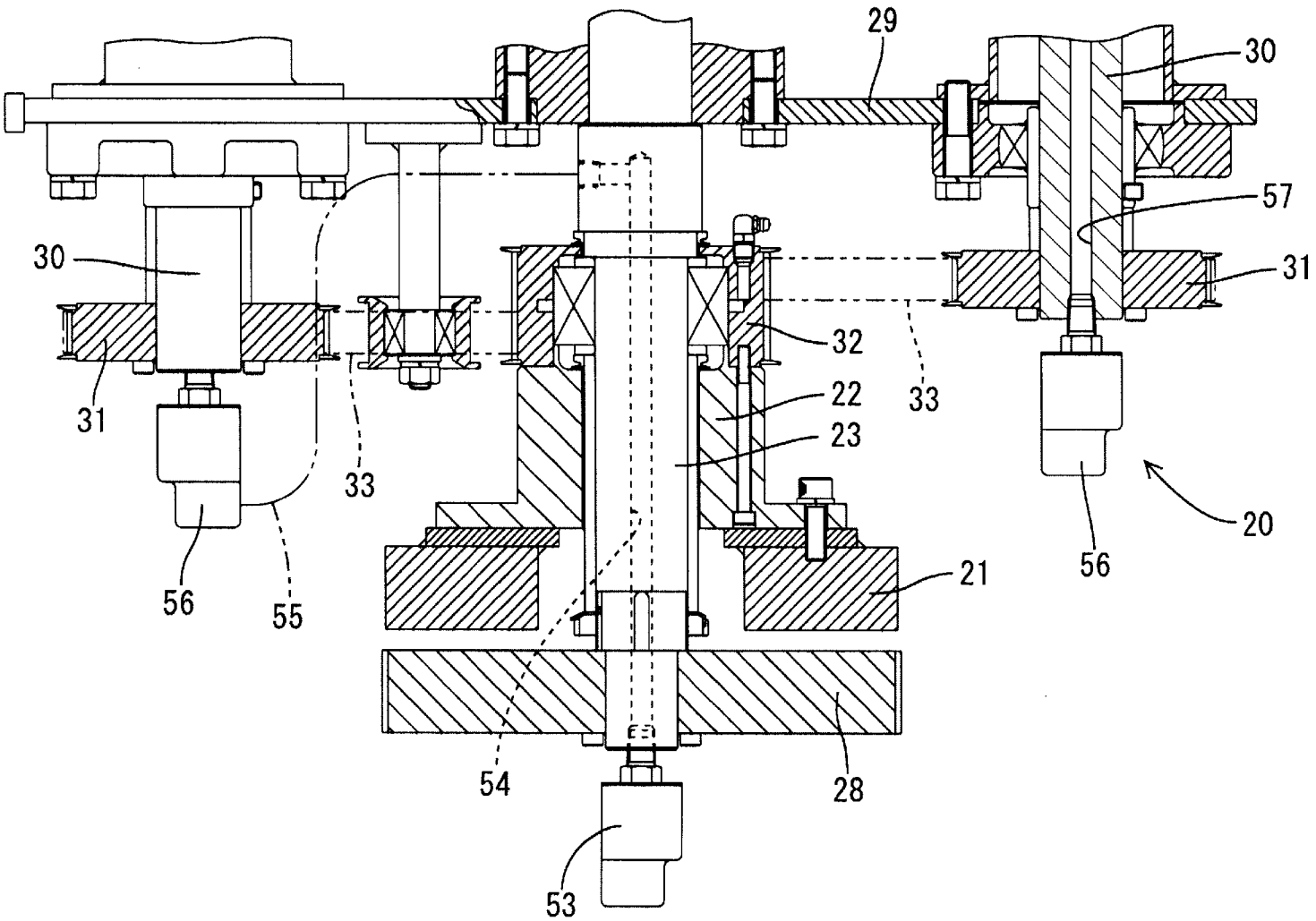
FIG. 3 is a partially enlarged section of an interlocking mechanism for first and second shafts.
Figure 4:
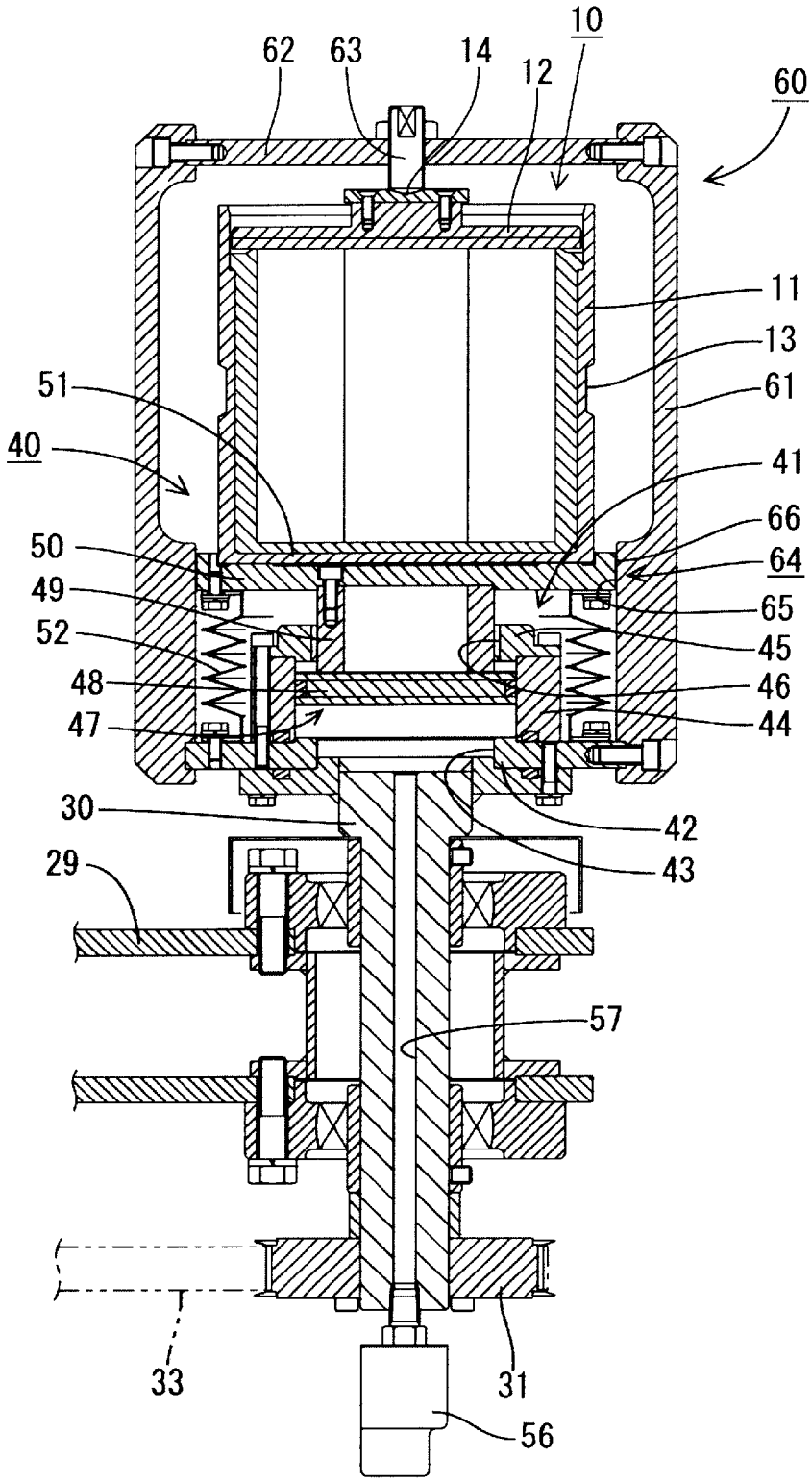
FIG. 4 is a partially enlarged section of the apparatus with a barrel being held thereon.
Figure 5:
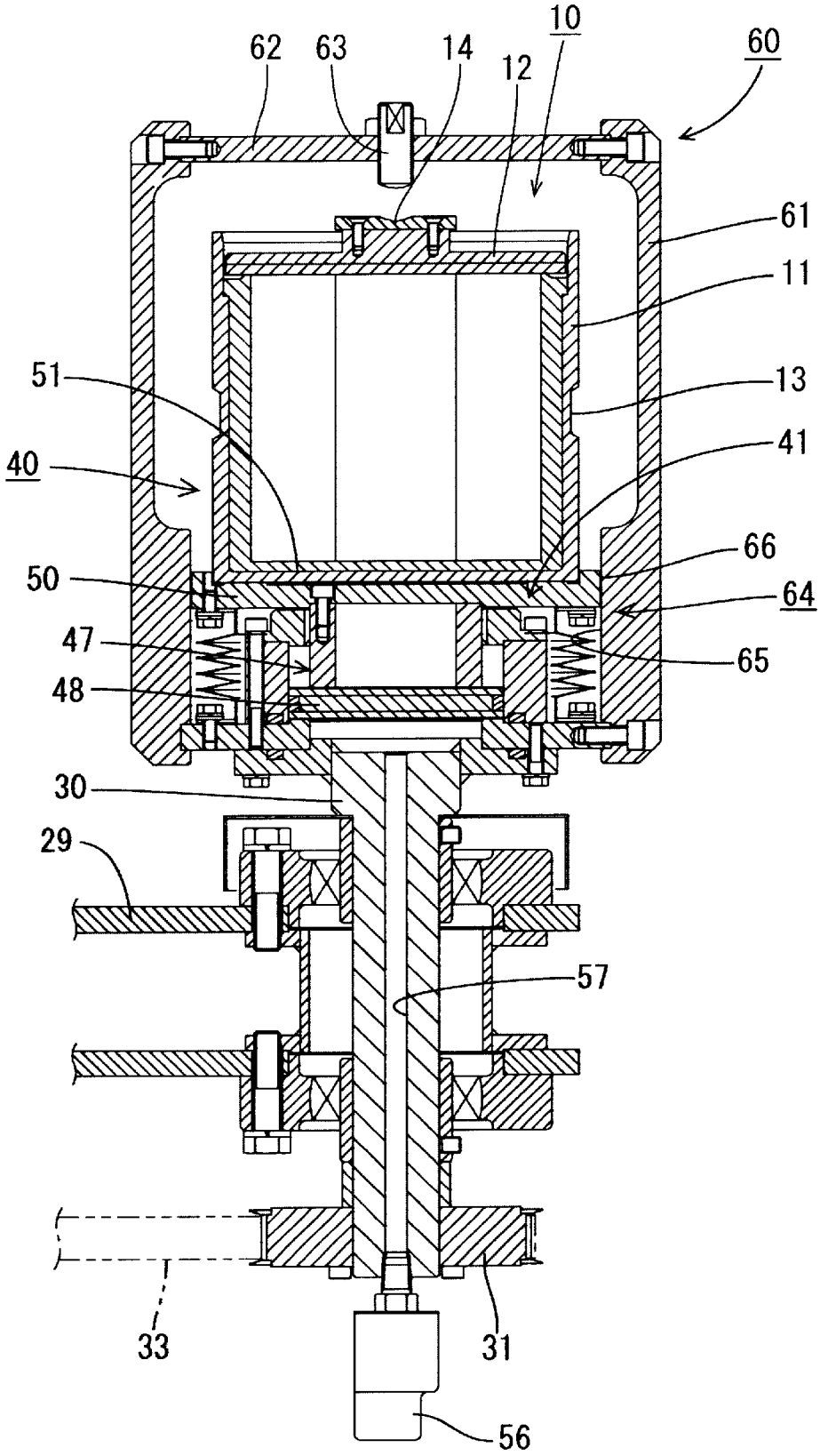
FIG. 5 is a partially enlarged section of the finishing apparatus, showing the barrel released from a held state.

One embodiment of the present invention will be described with reference to the accompanying drawings. The invention is applied to a centrifugal barrel finishing apparatus in the embodiment. The centrifugal barrel finishing apparatus of the embodiment includes four barrels 10 as shown in FIG. 2. Each barrel 10 comprises a bottomed cylindrical body 11 having an open upper end and a generally disk-like lid 12 for closing and opening the open upper end of the body 11. The barrel 10 is held vertically between a piston 47 and a stopper 60 such that the barrel is rotated together with a rotating shaft 30, as will be described in detail later. The barrel body 11 has a circumferential groove 13 formed in an outer circumferential wall thereof. The barrel 10 is gripped at the groove 13 by a robot hand 97 (see FIG. 8). The lid 12 has a recess 14 formed in a central portion of an upper side thereof.

A drive mechanism 20 includes a frame 21 on which a lower bearing 22 is secured. A vertically extending revolving shaft 23 is rotatably supported by the lower bearing 22. Torque developed by an electric motor 24 serving as a drive source is transmitted via a reduction mechanism 25, drive pulley 26, drive belt 27 and revolving pulley 28 to the revolving shaft 23. The revolving shaft 23 has an upper end on which a generally disk-like revolving turret 29 serving as a revolving member is secured so as to be turned with the revolving shaft. Four rotating shafts 30 are arranged circumferentially on the turret 29 at intervals of 90 degrees so as to be rotated relative to the turret. Each rotating shaft 30 has a lower end to which a rotating pulley 31 is connected. The revolving shaft 23 includes a fixed pulley 32 fixed to the lower bearing 22. A rotating belt 33 extends between the rotating pulleys 31 and the pulley 32. When the motor 24 is driven, each rotating shaft 30 is rotated on the turret 29 while being revolved together with the turret with rotation of the revolving shaft 23. Although the four rotating shafts 30 are mounted on the turret 29 in the embodiment, the number of rotating shafts 30 may be equal to or smaller than 3 or equal to or larger than 5.

A fluid pressure cylinder 40 includes a cylinder 41 and a piston 47. An annular lower disk 42 is fixed to the upper end of each rotating shaft 30. A cylinder body 44 is concentrically fixed to the lower disk 42. The cylinder body 44 has a larger diameter than a central hole 43 of the lower disk 42. The cylinder 41 is rotated together with the rotating shaft 30. The piston 47 includes a body 48 vertically slidable on an inner circumferential face of the cylinder body 44 so that an interior of the body 44 is airtight, a concentric intermediate member 49 fixed to an upper face of the body 48 and extending through the central hole 46 of the upper disk 45, and a generally circular mounting plate 50 fixed to an upper end of the intermediate member 49. The mounting plate 50 has a circular positioning recess 51 formed on an upper side thereof so as to be concentric with the rotating shaft 30. The body 11 of the barrel 10 is fitted into the recess 51 to be mounted so that a radial or horizontal movement thereof is limited. A generally bellows-like protecting member 52 is provided between an upper side of the lower disk 42 and an underside of the mounting plate so as to surround the cylinder 41.

Working fluid such as pressurized air fed from a pressurized air source 81 serving as a working fluid source is supplied into a lower end joint 56 of each rotating shaft 30 through a lower end joint 53 and an inner passage 54 of the revolving shaft 23 and a hose 55 connected to the upper end of the passage 54. Each rotating shaft 30 has a flow passage 57 formed therein so as to communicate between the joint 56 and a working space below the piston 47 in the cylinder 41. The working fluid is supplied through the flow passage 57 into the working space.

A generally gate-shaped stopper 60 is mounted on the rotating shaft 30 so as to be rotated with the rotating shaft 30. The stopper 60 includes a pair of vertical legs 61 having respective lower ends fixed to the outer circumferential edge of the lower disk 42 and a horizontal support 62 extending between upper ends of the legs 61. An elongate receiving member 63 is mounted on the horizontal support 62 so as to be coaxial with the rotating shaft 30 and to extend downward. A lower end of the receiving member 63 is fitted into the recess 14 of the lid 12 of the barrel 10.

Fitting means 64 will now be described. Both legs 61 have flat inner faces opposed to each other and serving as limiting faces 65 parallel with a direction in which the piston 47 is moved, respectively. The mounting plate 50 has a flat engaging face 66 formed on the circumferential edge thereof so as to be slidable on the limiting faces 65. The piston 47 is moved between an upper position where the barrel 10 is held and a lower position where the barrel 10 is released from the held state, while the engaging face 66 is in a sliding contact with the limiting faces 65. Furthermore, since the engaging face 66 and the limiting faces 65 are in abutment with each other, rotation of the mounting plate 50 is limited by the abutment of the engaging face 66 with the limiting faces 65 even when the mounting plate is caused to be rotated relative to the legs 61. Thus, the piston 47, stopper 60 and rotating shaft 30 are rotated together.

Figure 6:
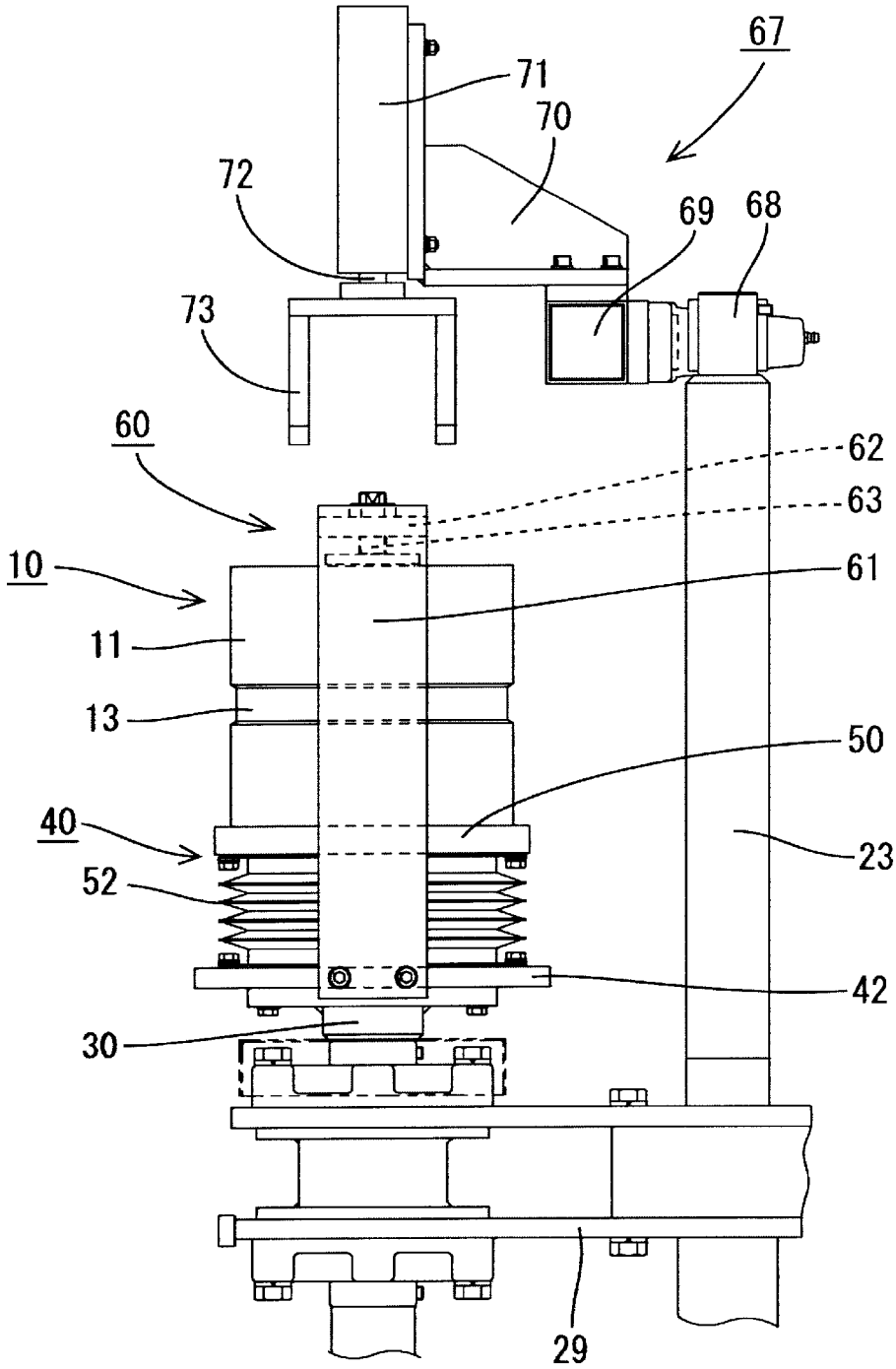
FIG. 6 is a partially enlarged side view of the finishing apparatus, showing the barrel in the held state.
Figure 7:
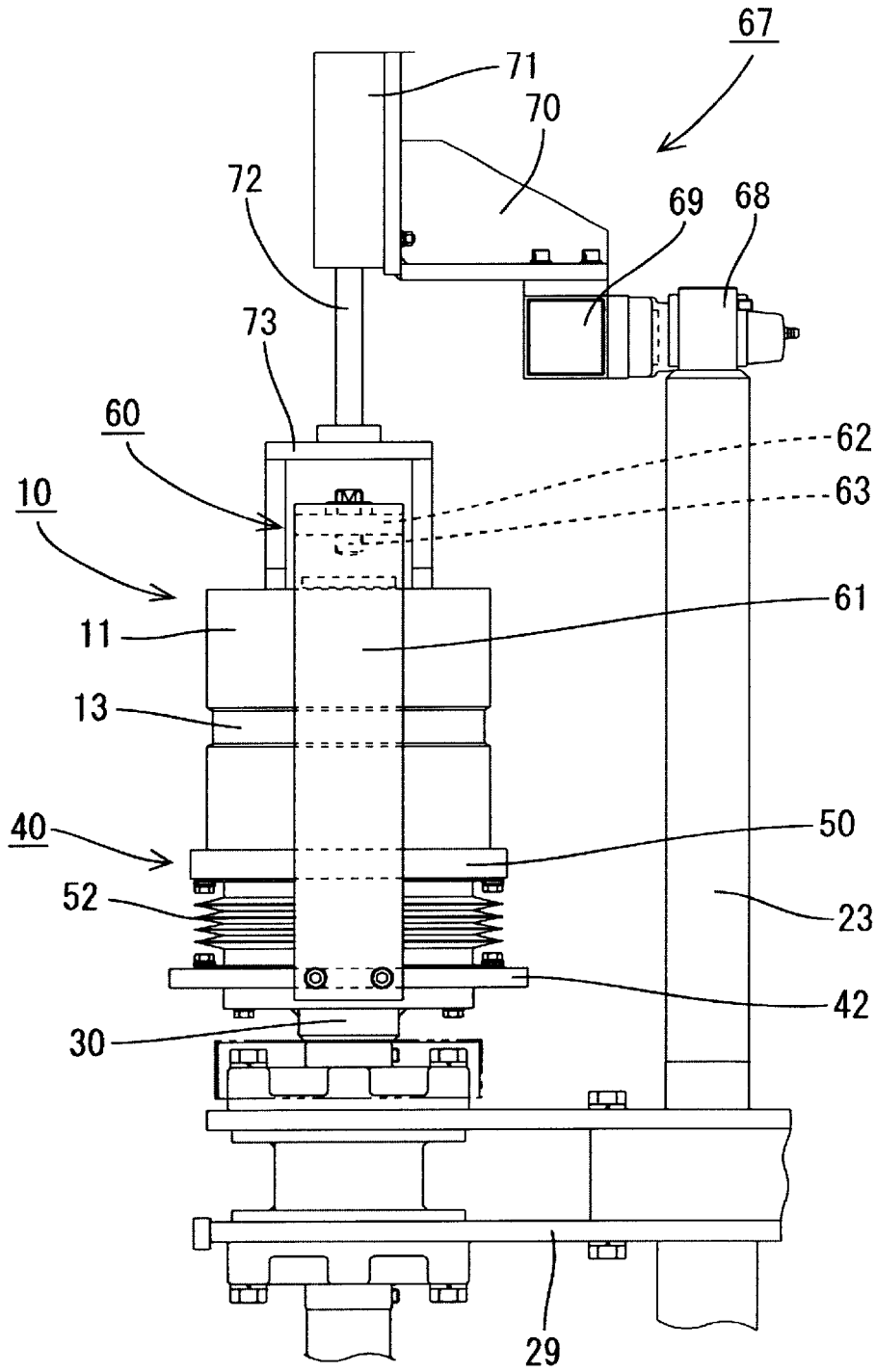
FIG. 7 is a partially enlarged side view of the finishing apparatus, showing the barrel caused to descend by releasing means.

An upper bearing 68 is provided for supporting the upper end of the revolving shaft 23 as shown in FIGS. 6 and 7. The bearing 68 is fixed to a beam 69 to which a bracket 70 is further fixed. The bracket 70 horizontally extends over the rotating shafts 30 and has an end on which a releasing air cylinder 71 is mounted. The cylinder 71 includes a downward rod 72 having a lower end to which a pushing member 73 is fixed. The pushing member 73 is bifurcated so as to straddle the horizontal support 62 of the stopper 60. The pushing member 73 downwardly pushes the upper side of the lid 12 of each barrel 10 placed on the piston 47 without interference with the horizontal support 62.

Figure 8:
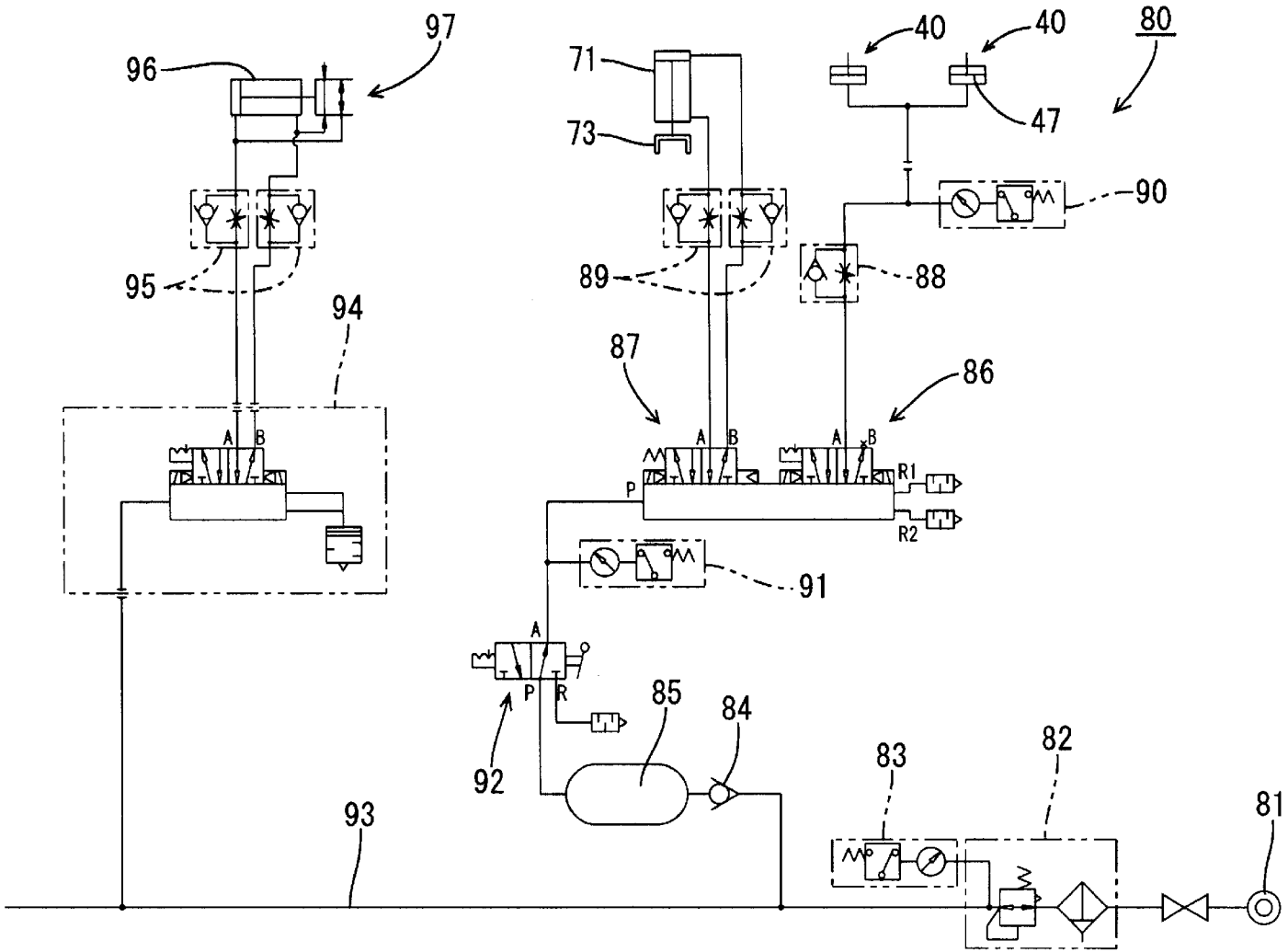
FIG. 8 illustrates a pneumatic circuit showing a supply circuit for supplying a working fluid to a fluid pressure cylinder and a releasing air cylinder.

The pressurized air source 81 is connected to a pressure reducing valve 82 provided with a pressure sensor 83, check valve 84 and a tank 85 serving as a spare pressurized air source, sequentially in this order. A holding solenoid valve 86 is provided for supplying the working fluid into the cylinder 40 so that the piston 47 is ascended, as shown in FIG. 8. A releasing solenoid valve 87 is provided for supplying the working fluid into the air cylinder 71 so that the pushing member 73 is ascended and descended. Both valves 86 and 87 are connected to the tank 85. A speed controller 88 is connected between the valve 86 and the cylinder 40 for adjusting a flow rate of the working fluid. Two speed controllers 89 are also connected between the valve 87 and the cylinder 71 for adjusting a flow rate of the working fluid (for ascent and descent of the pushing member 73). A pressure sensor 90 is connected between the cylinder 40 and the speed controller 88. A pressure sensor 91 is also connected between the tank 85 and the solenoid valves 86 and 87. Each pressure sensor detects a pressure drop of the working fluid. The centrifugal barrel finishing apparatus is deenergized when any one of the pressure sensors 83, 90 and 91 delivers a signal. Furthermore, a residual pressure treating valve 92 is connected between the tank 85 and the pressure sensor 91 for discharging the working fluid from the tank 85 when pressure in the tank 85 is not required.

Referring further to FIG. 8, a solenoid valve 94 for the robot is connected to a feed passage 93 divided between the pressure reducing valve 82 and the check valve 84. Two speed controllers 95 and an air cylinder 96 for the robot are connected to the valve 94. The robot hand 97 is actuated by the working fluid supplied by the valve 94 in order to carry the barrel 10.

The operation of the barrel finishing apparatus will now be described. Upon start of finishing, the piston 47 assumes a descended position, and the pushing member 73 of the releasing air cylinder 71 assumes an ascended position. Furthermore, the pressure of the working fluid in a pneumatic circuit 80 as shown in FIG. 8 is set at a predetermined value according to a net weight of the barrel 10 and workpieces to be polished. In the foregoing condition, the four barrels 10 are carried by the robot hand 97 one by one so that the barrels are placed on the pistons 47 respectively. The robot hand 97 is retracted when all the barrels 10 have been set. Thereafter, the holding solenoid valve 86 is opened so that the working fluid is supplied into the cylinder 40 of each rotating shaft 30. As a result, all the pistons 47 are ascended together with the barrels 10 being placed on the pistons respectively. When the recess 14 of each lid 12 collides with the receiving member 63 of the stopper 60 to be fitted with the receiving member, further ascent of the piston 47 and barrel 10 is prevented. As a result, each barrel 10 is held between the piston 47 and the stopper 60.

In order that whether each barrel 10 has been held may be confirmed, the each barrel is located beneath the releasing air cylinder 71 and the pushing member 73 is descended by a predetermined stroke. Whether each barrel 10 has been held depends upon whether the pushing member 73 is abutted against the lid 12 of the barrel 10. Under the held state, each barrel 10 is positioned so as to be concentric with the rotating shaft 30 as the result of fitting of the recess 51 and barrel body 11 and the receiving member 63 and the recess 14. A holding force of the piston 47 and stopper 60 depends upon the pressure of working fluid supplied into the cylinder 40.

In the above-described state, the motor 24 is driven so that the revolving turret 29 is rotated and each rotating shaft 30 is also rotated while being revolved. In this case, the piston 47, barrel 10 and stopper 60 are rotated together with the rotating shaft 30. The rotation causes a centrifugal force, and the workpieces are polished by polishing chips (not shown) by the effect of the centrifugal force.

The motor 24 is once deenergized upon expiration of a predetermined polishing time and thereafter re-energized so that the turret 29 is rotated at low speeds. When a dog (not shown) mounted on the circumferential edge of the turret 29 is detected by a proximity switch (not shown), the motor 24 is deenergized and a command for return to origin is delivered to the motor.

The motor 24 is rotated by a predetermined angle on the basis of the command so that one of the barrels 10 is located beneath the releasing air cylinder 71. Thereafter, the holding solenoid valve 86 is closed so that the supply of working fluid to the cylinder 40 is stopped. In this case, however, frictional resistance sometimes prevents the piston 47 from descending. In view of this problem, the releasing solenoid valve 87 is operated so that the pushing member 73 of the releasing air cylinder 71 is descended to press the upper side of the lid 12 of the barrel 10. As a result, the barrel 10 and the piston 47 are forced to be pushed downward together, whereby a space is defined between the lid 12 and the receiving member 63 of the stopper 60. The barrel 10 is then held by the robot hand 97 and moved horizontally while being caused to float from the positioning recess 51, so that the barrel is displaced from the piston 47.

When the barrel 10 has been displaced from the piston 47, the motor 24 is rotated by a predetermined angle (90 degrees) again so that another barrel 10 is located beneath the releasing air cylinder 71. The barrel 10 and piston 47 are descended by the push of the cylinder 71 in the same manner as described above. The robot hand 97 is then operated to displace the barrel 10 from the piston 47. A servo motor is used as the motor 24. Since a rotational angle of the servo motor is detected in the form of pulses, the barrel 10 can accurately be positioned beneath the releasing air cylinder 71.

According to the foregoing embodiment, the piston 47 and the stopper 60 serve as the means for holding each barrel 10 so that the barrel is rotatable together with the rotating shaft 30. The barrel 10 is held between the ascending piston 47 and the stopper 60 located over the piston. Accordingly, an appropriate holding force can be applied to the barrel 10 since the pressure of the working fluid supplied into the fluid pressure cylinder 40 is changed according to the weight of the barrel 10. Furthermore, the cylinder 40 and the piston 47 are concentric with the rotating shaft 30. Accordingly, the rotation center of the shaft 30 corresponds with the center of gravity of the assembly including the shaft 30 and the cylinder 40. Consequently, rotation of the shaft 30 can be rendered stable.

Furthermore, each rotating shaft 30 is formed with the flow passage 57 communicating with the cylinder 40. Consequently, the flow passage 57 can provide a better spacing efficiency as compared with a case where a flow passage is formed outside each rotating shaft. Furthermore, when each barrel 10 has been held by the piston 47 and stopper 60, the piston located below the barrel is in abutment with the barrel body 11 and the stopper located over the barrel is in abutment with the lid 12. The stopper 60 and the piston 47 are integrated by the fitting means 64. Accordingly, the barrel body 11 and the lid 12 are also rotated together. This can prevent slippage resulting from difference in the rotational speeds of the barrel body 11 and the lid 12.

Furthermore, even when the self-weights of the piston 47 and the barrel 10 are too small to overcome the frictional resistance, each barrel 10 can be forced to descend since the releasing means 67 moves the piston 47 away from the stopper 60. Consequently, a space utilized to displace the barrel 10 can be ensured between the barrel and the stopper 60. Additionally, the cylinder mechanism driven by the working fluid is provided as the means for placing and displacing each barrel 10 on and from the rotating shaft 30. The cylinder mechanism includes the fluid pressure cylinder 40 and the releasing air cylinder 71. Consequently, each barrel 10 can be attached to and detached from the shaft 30 more efficiently as compared with a case where a clamping mechanism requiring screwing.

Several modified forms will now be described. In the foregoing embodiment, the fluid pressure cylinder 40 and the stopper 60 are mounted on each rotating shaft 30 further mounted on the single revolving member. However, two pairs of the revolving member and rotating shaft may be provided instead. In this case, the fluid pressure cylinder may be provided on one of the rotating shafts, and the stopper may be provided on the other rotating shaft.

Although the fluid pressure cylinder is concentric with the rotating shaft in the foregoing embodiment, the cylinder may be eccentric relative to the rotating shaft. Furthermore, the flow passage for the working fluid is formed inside each rotating shaft in the foregoing embodiment. However, the passage may be formed outside each rotating shaft instead. Furthermore, the fluid pressure cylinder is disposed below the barrel, whereas the stopper is disposed over the barrel in the foregoing embodiment. However, the fluid pressure cylinder may be disposed over the barrel and the stopper may be disposed below the barrel, instead. Additionally, each barrel is pushed by the releasing means such that the piston is detached from the stopper in the foregoing embodiment. However, the piston may directly be pushed by the releasing means so as to depart from the stopper, instead.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A centrifugal barrel finishing apparatus comprising:

a revolving member mounted on a first rotatable shaft so as to be rotated with the first shaft;

a barrel provided to be rotated about a second shaft, the second shaft being rotatably mounted to the revolving member;

a stopper provided on the second shaft so as to be abutted against one axial end side of the barrel; and a fluid pressure cylinder including a piston and mounted on the second shaft so as to push the other axial end side of the barrel so that the barrel is held between the stopper and the cylinder.

2. A centrifugal barrel finishing apparatus according to claim 1, wherein the fluid pressure cylinder is concentric with the second shaft.

3. A centrifugal barrel finishing apparatus according to claim 2, wherein the piston has an upper end on which a mounting plate is mounted and the mounting plate has an upper side formed with a positioning recess limiting a radial movement of the barrel.

4. A centrifugal barrel finishing apparatus according to claim 2, wherein the second shaft has a hollow interior serving as a flow passage of a working fluid, the flow passage communicating with the cylinder.

5. A centrifugal barrel finishing apparatus according to claim 4, wherein the first shaft is formed with a flow passage for the working fluid, the apparatus further comprising a conduit connecting between the flow passages of the first and second shafts.

6. A centrifugal barrel finishing apparatus according to claim 2, wherein the piston has an upper end on which a mounting plate is mounted, wherein the barrel includes a body having an open end and a lid closing the open end of the body, wherein either one of the piston and the stopper is abutted against the body of the barrel, whereas the other is abutted against the lid of the barrel, and wherein the stopper is formed into a shape of a frame surrounding the barrel and has an inner face guiding movement between a first position where the stopper is brought into a sliding contact with the mounting plate so that the barrel is held between the piston and the stopper and a second position where the barrel is released from a held state.

7. A centrifugal barrel finishing apparatus according to claim 1, wherein the piston has an upper end on which a mounting plate is mounted and the mounting plate has an upper side formed with a positioning recess limiting a radial movement of the barrel.

8. A centrifugal barrel finishing apparatus according to claim 7, wherein the second shaft has a hollow interior serving as a flow passage of a working fluid, the flow passage communicating with the cylinder.

9. A centrifugal barrel finishing apparatus according to claim 8, wherein the first shaft is formed with a flow passage for the working fluid, the apparatus further comprising a conduit connecting between the flow passages of the first and second shafts.

10. A centrifugal barrel finishing apparatus according to claim 7, wherein the barrel includes a body having an open end and a lid closing the open end of the body, wherein either one of the piston and the stopper is abutted against the body of the barrel, whereas the other is abutted against the lid of the barrel, and wherein the stopper is formed into a shape of a frame surrounding the barrel and has an inner face guiding movement between a first position where the stopper is brought into a sliding contact with the mounting plate so that the barrel is held between the piston and the stopper and a second position where the barrel is released from a held state.

11. A centrifugal barrel finishing apparatus according to claim 1, wherein the second shaft has a hollow interior serving as a flow passage of a working fluid, the flow passage communicating with the cylinder.

12. A centrifugal barrel finishing apparatus according to claim 11, wherein the first shaft is formed with a flow passage for the working fluid, the apparatus further comprising a conduit connecting between the flow passages of the first and second shafts.

13. A centrifugal barrel finishing apparatus according to claim 12, wherein the piston has an upper end on which a mounting plate is mounted, wherein the barrel includes a body having an open end and a lid closing the open end of the body, wherein either one of the piston and the stopper is abutted against the body of the barrel, whereas the other is abutted against the lid of the barrel, and wherein the stopper is formed into a shape of a frame surrounding the barrel and has an inner face guiding movement between a first position where the stopper is brought into a sliding contact with the mounting plate so that the barrel is held between the piston and the stopper and a second position where the barrel is released from a held state.

14. A centrifugal barrel finishing apparatus according to claim 11, wherein the piston has an upper end on which a mounting plate is mounted, wherein the barrel includes a body having an open end and a lid closing the open end of the body, wherein either one of the piston and the stopper is abutted against the body of the barrel, whereas the other is abutted against the lid of the barrel, and wherein the stopper is formed into a shape of a frame surrounding the barrel and has an inner face guiding movement between a first position where the stopper is brought into a sliding contact with the mounting plate so that the barrel is held between the piston and the stopper and a second position where the barrel is released from a held state.

15. A centrifugal barrel finishing apparatus according to claim 1, wherein the piston has an upper end on which a mounting plate is mounted, wherein the barrel includes a body having an open end and a lid closing the open end of the body, wherein either one of the piston and the stopper is abutted against the body of the barrel, whereas the other is abutted against the lid of the barrel, and wherein the stopper is formed into a shape of a frame surrounding the barrel and has an inner face guiding movement between a first position where the stopper is brought into a sliding contact with the mounting plate so that the barrel is held between the piston and the stopper and a second position where the barrel is released from a held state.

16. A centrifugal barrel finishing apparatus according to claim 15, wherein the inner face of the stopper and the mounting plate are brought into contact with each other face-to-face that the stopper is prevented from movement relative to the mounting plate.

17. A centrifugal barrel finishing apparatus according to claim 1, further comprising releasing means for moving the piston away from the stopper.

18. A centrifugal barrel finishing apparatus comprising:

an electric motor;

a first shaft rotated by the electric motor;

a revolving member mounted on the first shaft to be rotated with the first shaft;

a working fluid source supplying a working fluid;

a second shaft rotatably mounted on the revolving member and having a hollow interior serving as a flow passage of the working fluid supplied from the working fluid source;

a barrel detachably mounted on the second shaft so as to be rotated with the second shaft while being revolved about the first shaft with rotation of the revolving member, the barrel having both axial ends;

a stopper provided on the second shaft so as to be abutted against one axial end side of the barrel;

a fluid pressure cylinder mounted on the second shaft so as to communicate with the flow passage of the second shaft and including a piston actuated by the working fluid supplied from the working fluid source via the flow passage of the second shaft into the fluid pressure cylinder so that the piston pushes the other axial end side of the barrel so that the barrel is held between the stopper and the cylinder.

* * * * *